US010610996B2

(12) United States Patent
Bin et al.

(10) Patent No.: US 10,610,996 B2
(45) Date of Patent: Apr. 7, 2020

(54) LAPPING DEVICE

(71) Applicants: Samsung Display Co., Ltd., Yongin-si, Gyeonggi-do (KR); Byoungchul Park, Hwaseong-si, Gyeonggi-do (KR)

(72) Inventors: Younkyun Bin, Hwaseong-si (KR); Byoungchul Park, Hwaseong-si (KR)

(73) Assignees: Samsung Display Co., Ltd., Yongin-si (KR); Byoungchul Park, Hwaseong-si (KR)

( * ) Notice: Subject to any disclaimer, the term of this patent is extended or adjusted under 35 U.S.C. 154(b) by 107 days.

(21) Appl. No.: 15/701,268

(22) Filed: Sep. 11, 2017

(65) Prior Publication Data

US 2018/0071887 A1 Mar. 15, 2018

(30) Foreign Application Priority Data

Sep. 12, 2016 (KR) ..... 10-2016-0117392

(51) Int. Cl.

| | |
|---|---|
| ***B24B 37/22*** | (2012.01) |
| ***B24D 13/12*** | (2006.01) |
| ***B24D 13/14*** | (2006.01) |
| ***B24D 9/00*** | (2006.01) |
| ***B24B 37/24*** | (2012.01) |
| ***B24B 37/26*** | (2012.01) |

(52) U.S. Cl.

CPC ..... *B24B 37/22* (2013.01); *B24B 37/245* (2013.01); *B24B 37/26* (2013.01); *B24D 9/003* (2013.01); *B24D 13/12* (2013.01); *B24D 13/142* (2013.01); *B24D 13/147* (2013.01)

(58) Field of Classification Search

CPC ..... B24B 37/22; B24B 37/245; B24B 37/26; B24D 9/003; B24D 13/12; B24D 13/142; B24D 13/147

USPC ..... 451/178

See application file for complete search history.

(56) References Cited

U.S. PATENT DOCUMENTS

| | | | | |
|---|---|---|---|---|
| 1,575,267 A * | 3/1926 | Houldsworth | B24B 33/08 451/478 |
| 2,444,760 A * | 7/1948 | Tambini | B24D 13/142 451/505 |
| 3,416,265 A * | 12/1968 | Marton | B24D 9/085 451/513 |
| 10,414,026 B2 * | 9/2019 | Johnson | B23B 51/10 |
| 2006/0053576 A1 * | 3/2006 | McLain | B24D 9/085 15/230 |
| 2009/0191800 A1 * | 7/2009 | Rivard | B24D 9/003 451/466 |

FOREIGN PATENT DOCUMENTS

| | | |
|---|---|---|
| KR | 10-2006-0000935 A | 1/2006 |
| KR | 10-2009-0046459 A | 5/2009 |
| KR | 10-2013-0078510 A | 7/2013 |
| KR | 10-2014-0125006 A | 10/2014 |
| KR | 10-2015-0142507 A | 12/2015 |

* cited by examiner

*Primary Examiner* — George B Nguyen

(74) *Attorney, Agent, or Firm* — Lewis Roca Rothgerber Christie LLP

(57) ABSTRACT

A lapping device is provided that is capable of precisely lapping a surface of an object having a complicated shape, the lapping device including a driving unit, a shank connected to the driving unit through a driving shaft, and a lapping portion coupled to the shank. The lapping portion includes an abrasive layer and an elastic member between the abrasive layer and the shank.

21 Claims, 14 Drawing Sheets

| | Surface roughness (Ra) of mold after lapping | Dimension change of mold after lapping | Lapping time |
|---|---|---|---|
| Conventional lapping device | 1.0~2㎛ | 0~10㎛ | 40min/Frontal surface<br>40min/Rear surface |
| Lapping device of the present invention | 0.6~0.8㎛ | 2~5㎛ | 20min/Frontal surface<br>20min/Rear surface |

LAPPING DEVICE

CROSS-REFERENCE TO RELATED APPLICATION

This application claims priority to and the benefit of Korean Patent Application No. 10-2016-0117392, filed on Sep. 12, 2016, in the Korean Intellectual Property Office (KIPO), the entire content of which is hereby incorporated by reference.

BACKGROUND

1. Field

One or more aspects of example embodiments of the present disclosure relate to a lapping device, and more particularly, to a lapping device capable of precisely lapping a surface of an object having a complicated shape.

2. Description of Related Art

Lapping devices may be used to lap a variety of materials, including metal, wood, synthetic resin materials, glass materials and/or the like.

In the case where an object to be lapped has a surface with a complicated shape (e.g., a curved surface), conventional lapping devices may not lap the surface precisely.

It is to be understood that this description of related art is intended to provide useful background for understanding the present disclosure, and as such, the description of related art may include ideas, concepts or recognitions that were not part of what was known or appreciated by those skilled in the pertinent art prior to a corresponding effective filing date of subject matter disclosed herein.

SUMMARY

Aspects of embodiments of the present disclosure are directed to a lapping device capable of precisely lapping a surface of an object having a complicated shape.

According to some embodiments of the present disclosure, a lapping device includes a driving unit, a shank connected to the driving unit through a driving shaft, and a lapping portion coupled to the shank. The lapping portion includes an abrasive layer and an elastic member between the abrasive layer and the shank.

In some embodiments, the abrasive layer may include sandpaper.

In some embodiments, the elastic member may be a sponge.

In some embodiments, the lapping device may further include an adhesive between the elastic member and the shank.

A first portion of the lapping portion may be positioned at a tip portion of the shank, and a second portion of the lapping portion may be positioned at an outer circumferential surface of the shank.

The first portion of the lapping portion may have one of a linear shape, a cross shape, a Y-like shape, a star (*)-like shape and a #-like shape.

The second portion of the lapping portion may have a linear shape.

The shank may have a groove into which at least a portion of the elastic member is inserted.

When the elastic member is positioned in the groove of the shank, a portion of the elastic member may protrude outside of the groove.

A first part of the groove may be positioned at a tip portion of the shank, and a second part of the groove may be positioned at an outer circumferential surface of the shank.

The first part of the groove may have one of a linear shape, a cross shape, a Y-like shape, a star (*)-like shape and a #-like shape.

The second part of the groove may have a linear shape.

The lapping device may further include a fastening portion surrounding an outer circumferential surface of the shank and the lapping portion on the outer circumferential surface of the shank.

The fastening portion may have a hole or opening through which a portion of the lapping portion and a portion of the shank are exposed (e.g., the lapping portion and the shank may be inserted into the hole of the fastening portion, such that the lapping portion and the shank extend through the hole and outside of the fastening portion).

The foregoing is illustrative only and is not intended to be in any way limiting. In addition to the illustrative aspects, example embodiments, and features described above, further aspects, example embodiments and features will become apparent by reference to the drawings and the following detailed description.

BRIEF DESCRIPTION OF THE DRAWINGS

The above and other advantages of the present disclosure will become more apparent by reference to the following detailed description when considered in conjunction with the accompanying drawings, wherein.

DETAILED DESCRIPTION

Figure 1:
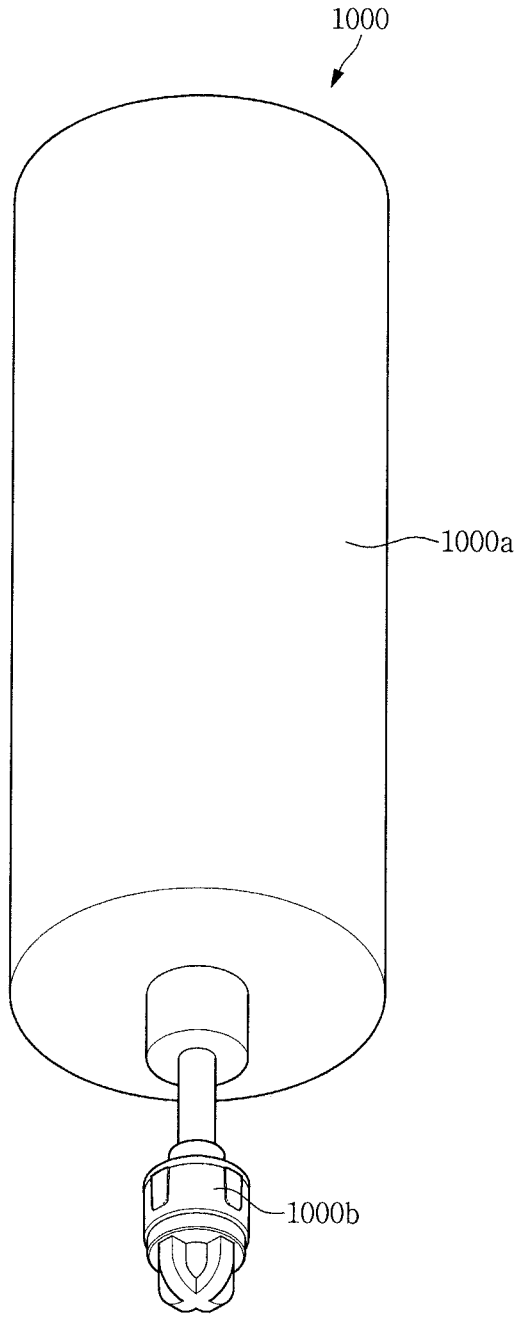
FIG. 1 is a perspective view illustrating a lapping device according to some embodiments.

Hereinafter, example embodiments will now be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

In the drawings, thicknesses of a plurality of layers and areas are illustrated in an enlarged manner for clarity and ease of description thereof.

It will be understood that when a layer, area, element, or plate is referred to as being "on," "connected to," or "coupled to" another layer, area, or plate, it may be directly on, connected, or coupled to the other layer, area, element, or plate, or intervening layers, areas, elements, or plates may be present therebetween. Conversely, when a layer, area, element, or plate is referred to as being "directly on," "directly connected to," or "directly coupled to" another layer, area, element, or plate, there are no intervening layers, areas, elements or plates therebetween. In addition, it will also be understood that when a layer, area, element, or plate is referred to as being "between" two layers, areas, elements, or plates, it can be the only layer, area, element, or plate between the two layers, areas, elements, or plates, or one or more intervening layers, areas, elements, or plates may also be present. Further when a layer, area, element, or plate is referred to as being "below" another layer, area, element, or plate, it may be directly below the other layer, area, element, or plate, or intervening layers, areas, elements, or plates may be present therebetween. Conversely, when a layer, area, or plate is referred to as being "directly below" another layer, area, element, or plate, intervening layers, areas, elements, or plates may be absent therebetween.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

Expressions such as "at least one of," when preceding a list of elements, modify the entire list of elements and do not only modify the individual elements of the list. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Spatially relative terms such as "below", "beneath", "lower", "above", "upper" and the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the example terms "below" and "under" may include both an orientation of above and below. The device may be otherwise oriented (e.g., rotated 90 degrees or at other orientations) and the spatially relative descriptors used herein should be interpreted accordingly.

It will be further understood that the terms "comprises," "comprising," "includes" and/or "including," when used in this specification, specify the presence of stated features, integers, steps, operations, elements and/or components, but do not preclude the presence or addition of one or more other features, integers, steps, operations, elements, components and/or groups thereof.

It will be understood that, although the terms "first," "second," "third," and the like may be used herein to describe various elements, components, regions, layers and/or sections, these elements, components, regions, layers and/or sections should not be limited by these terms. The use of the terms first, second, etc. do not denote any order or importance, but rather the terms first, second, etc. are used to distinguish one element from another element. Thus, a first element, component, region, layer, or section discussed below could be termed a second element, component, region, layer or section without departing from the teachings herein.

As used herein, the terms "substantially," "about," "approximately" and similar terms are used as terms of approximation and not as terms of degree, and are intended to account for the inherent deviations in measured or calculated values that would be recognized by those of ordinary skill in the art. Further, these terms as used herein are inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Unless otherwise defined, all terms used herein (including technical and scientific terms) have the same meaning as commonly understood by those skilled in the art to which this invention pertains. It will be further understood that terms, such as those defined in commonly used dictionaries, should be interpreted as having a meaning that is consistent with their meaning in the context of the relevant art and will not be interpreted in an ideal or excessively formal sense unless clearly defined in the present specification.

Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Hereinafter, a lapping device according to some embodiments will be described with reference to FIGS. 1 to 16.

Figure 2:
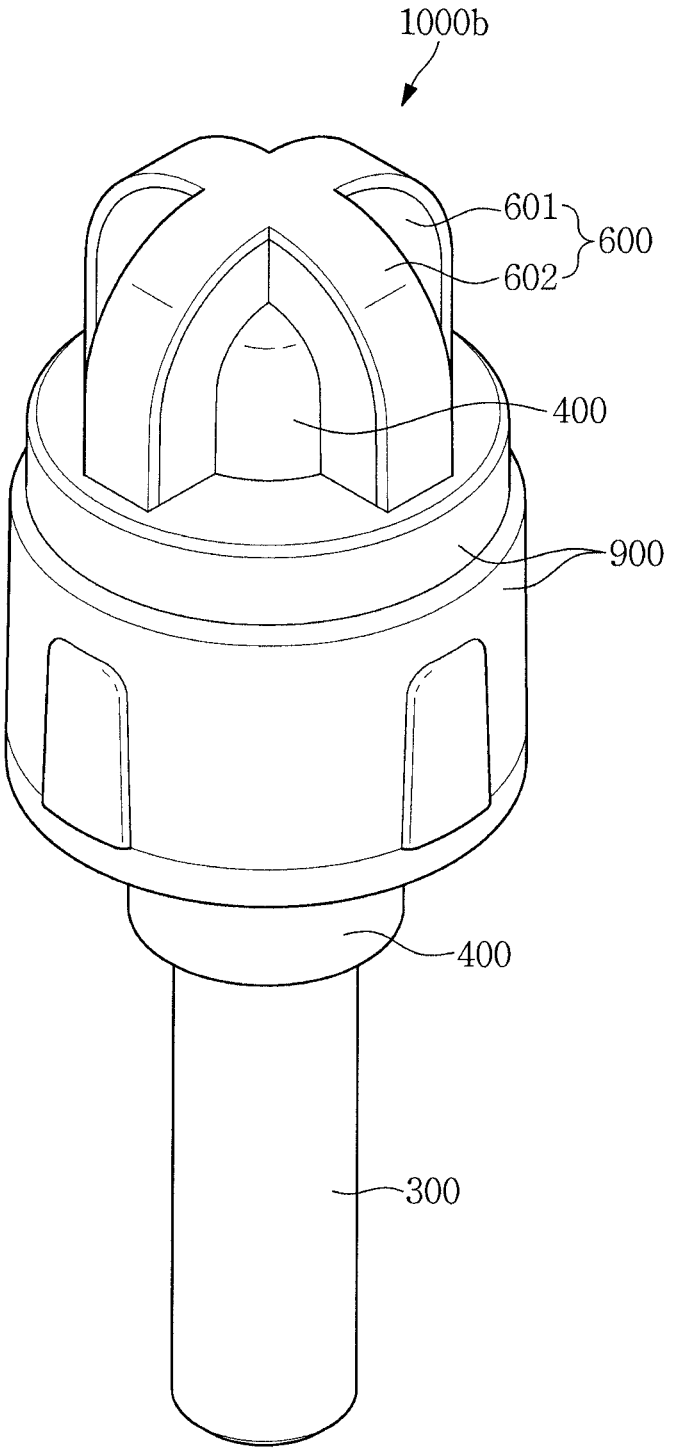
FIG. 2 is an enlarged view illustrating a wheel unit of FIG. 1.
Figure 3:
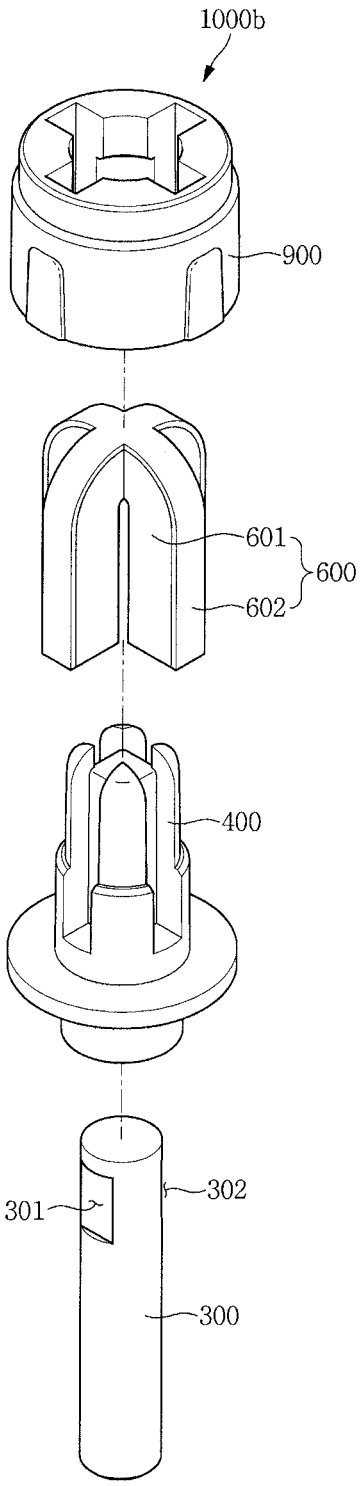
FIG. 3 is an exploded perspective view illustrating the wheel unit of FIG. 2.

FIG. 1 is a perspective view illustrating a lapping device according to some embodiments, FIG. 2 is an enlarged view illustrating a wheel unit of FIG. 1, and FIG. 3 is an exploded perspective view illustrating the wheel unit of FIG. 2.

A lapping device 1000 according to some embodiments includes a driving unit 1000*a* and a wheel unit 1000*b*, as illustrated in FIG. 1. The wheel unit 1000*b* is coupled to the driving unit 1000*a*. The wheel unit 1000*b* may be rotated by a rotational force provided by or transmitted from the driving unit 1000*a*. In some embodiments, the driving unit 1000*a* may be a spindle motor.

As illustrated in FIGS. 2 and 3, the wheel unit 1000*b* may include a driving shaft 300, a shank 400, a lapping portion 600 and a fastening portion 900. In some embodiments, the fastening portion 900 of the wheel unit 1000*b* may be omitted.

The driving shaft 300 of the wheel unit 1000*b* is positioned between the driving unit 1000*a* and the shank 400. A first end portion of the driving shaft 300 may be coupled to the driving unit 1000*a* and a second end portion of the driving shaft 300 may be coupled to the shank 400. In some embodiments, the driving shaft 300 may have a cylindrical shape, and an axial direction of the driving shaft 300 may be defined by the first end portion and the second end portion. The driving shaft 300 may be rotated by the rotational force provided by the driving unit 1000*a*. The driving shaft 300 transmits the rotational force from the driving unit 1000*a* to the shank 400.

The driving shaft 300 may have one or more engagement grooves 301, 302 at the second end portion for coupling the drive shaft 300 to the shank 400. For example, the driving shaft 300 may have a first engagement groove 301 and a second engagement groove 302 at the second end portion of the driving shaft 300. The second engagement groove 302 may be located at an opposite side of the first engagement groove 301 (e.g., relative to a plane including an axis of rotation of the driving shaft 300). It should be appreciated that the number of engagement grooves may differ in different embodiments.

The shank 400 may have an opening (e.g., in the shape of a groove) into which the second end portion of the driving shaft 300 may be inserted. In some embodiments, the first engagement groove 301 and the second engagement groove 302 of the driving shaft 300 are configured to engage a first projecting protrusion and a second projecting protrusion, respectively, defined at an inner wall of the opening of the shank 400. When coupled, the shank 400 rotates in substantially the same direction as a rotational direction of the driving shaft 300 (i.e., clockwise or counterclockwise).

The lapping portion 600 may be coupled to the shank 400, as further described below. When coupled, the lapping portion 600 rotates in substantially the same direction as the rotational direction of the shank 400 (i.e., clockwise or counterclockwise). In use, the lapping portion 600 contacts an object to be lapped to lap a surface of the object. The lapping portion 600 may include an elastic member 601 and an abrasive layer 602. The lapping portion 600 may have a larger diameter than that of the shank 400.

The fastening portion 900 of the wheel unit 1000*b* fastens the lapping portion 600 to the shank 400, as further described below. In some embodiments, the fastening portion 900 surrounds the lapping portion 600 to couple the lapping portion 600 to the shank 400, and prevents the lapping portion 600 from being separated from the shank 400. The diameter of the lapping portion 600 may be smaller than the diameter of the fastening portion 900.

The wheel unit 1000*b* will be described in more detail with reference to FIGS. 4 to 14.

Figure 4:
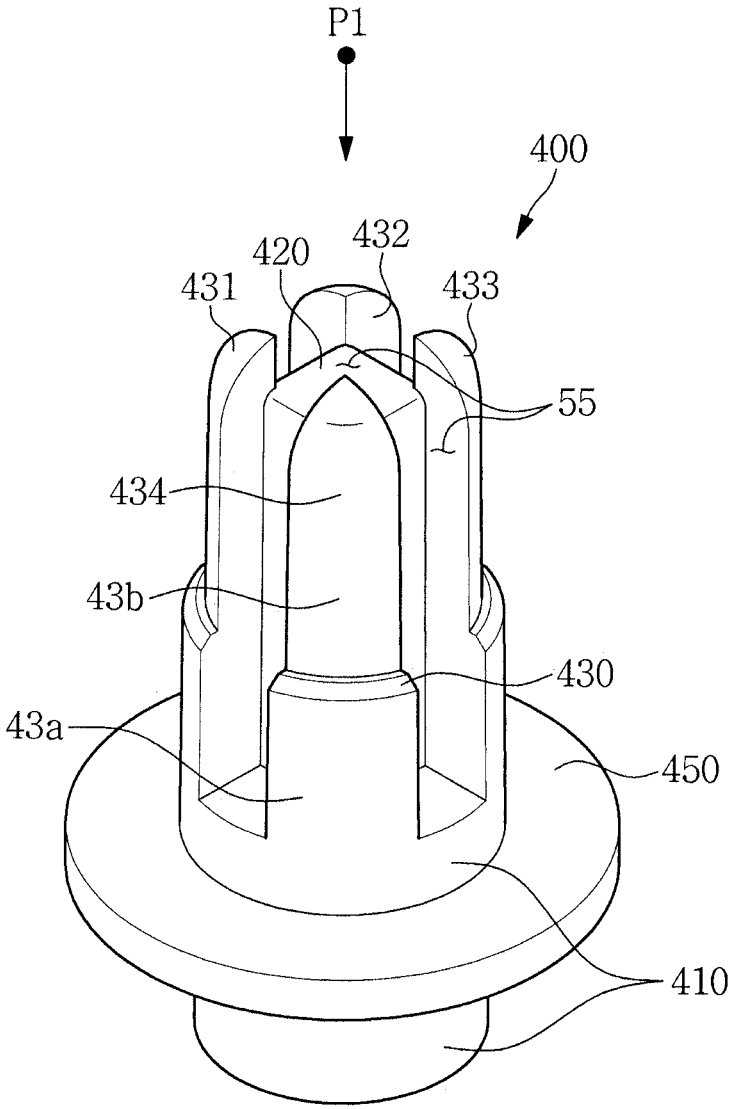
FIG. 4 is an enlarged view illustrating a shank of FIG. 3.
Figure 5:
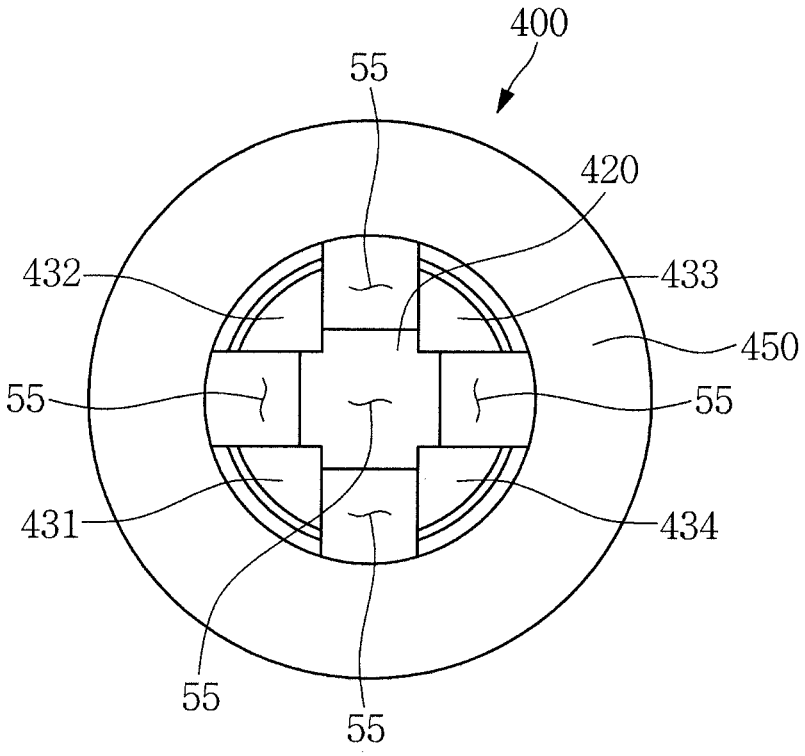
FIG. 5 is a view illustrating the shank of FIG. 4 viewed from a reference point P1 of FIG. 4.

FIG. 4 is an enlarged view illustrating the shank 400 of FIG. 3, and FIG. 5 is a view illustrating the shank 400 of FIG. 4 viewed from a reference point P1 of FIG. 4.

As illustrated in FIGS. 4 and 5, the shank 400 may have a groove 55 for coupling the shank 400 to the lapping portion 600. For example, in some embodiments, at least a portion of the lapping portion 600 may be inserted into the groove 55. The groove 55 may include a first part positioned at a tip portion of the shank 400 and a second part positioned at an outer circumferential surface of the shank 400.

As illustrated in FIG. 4, the groove 55 may have a linear shape (or an I-like shape) defined by the outer circumferential surface of the shank 400. As illustrated in FIG. 5, the first part of the groove 55 at the tip portion of the shank 400 may have a cross shape.

In some embodiments, at least two second parts of the groove 55 may be defined in the outer circumferential surface of the shank 400, and the second parts of the groove 55 may be arranged at regular intervals along the outer circumferential surface of the shank 400. For example, in some embodiments, the second parts of the groove 55 may be positioned at approximately 90° relative to each other along the outer circumferential surface of the shank 400.

As illustrated in FIGS. 4 and 5, the shank 400 may include a base portion 410, a central portion 420 and four side portions 431, 432, 433 and 434.

The base portion 410 of the shank 400 may be connected to the driving shaft 300. In some embodiments, the base portion 410 may have the opening described above into which the second end portion of the driving shaft 300 may be inserted to connect the driving shaft 300 to the shank 400. The base portion 410 may have a cylindrical or circular column shape, as illustrated in FIG. 4.

The central portion 420 of the shank 400 extends (e.g., protrudes) from a central portion of the base portion 410. The position of the central portion 420 may correspond to the position of the driving shaft 300. In some embodiments, the central portion 420 may extend in a direction parallel to the axial direction of the driving shaft 300, and in some embodiments, the central portion 420 may be positioned along the axial direction of the driving shaft 300. The central portion 420 may have a shape of a quadrangular column, as illustrated in FIGS. 4 and 5. The central portion 420 may have a cross-section such as a quadrangle or a rectangle.

Each of the side portions 431, 432, 433 and 434 of the shank 400 may extend (e.g., protrude) from an edge of the base portion 410, and may extend in a direction parallel to the axial direction of the driving shaft 300. Each of the side portions 431, 432, 433 and 434 is positioned around the central portion 420. For example, as illustrated in FIGS. 4 and 5, the side portions 431, 432, 433 and 434 may be positioned adjacent to (e.g., corresponding to) respective relatively long edges of the central portion 420 that are substantially parallel to the axial direction of the driving shaft 300.

For example, the first side portion 431 may be positioned at a first edge of the central portion 420, the second side portion 432 may be positioned at a second edge of the central portion 420, the third side portion 433 may be positioned at a third edge of the central portion 420, and the fourth side portion 434 may be positioned at a fourth edge of the central portion 420.

Each of the side portions 431, 432, 433 and 434 may have a shape of a fan-shaped column. Each of the side portions 431, 432, 433 and 434 may have a fan-shaped cross-section.

As illustrated in FIG. 4, each of the side portions 431, 432, 433 and 434 of the shank 400 may have a longer length than the length of the central portion 420 of the shank 400 measured in a direction substantially parallel to the axial direction of the driving shaft 300.

As illustrated in FIG. 4, the side portions 431, 432, 433 and 434 of the shank 400 are spaced apart from each other by a predetermined distance. The second parts of the groove 55 positioned at the outer circumferential surfaces of the shank 400 are defined by the side portions 431, 432, 433 and 434, side surfaces of the central portion 420 (positioned between the side portions 431, 432, 433 and 434), and the base portion 410.

As illustrated in FIG. 5, the first part of the groove 55 positioned at the tip portion of the shank 400 is defined by the four side portions 431, 432, 433 and 434, and an upper surface of the central portion 420 opposite to the driving shaft 300.

As illustrated in FIG. 4, each of the side portions 431, 432, 433 and 434 of the shank 400 may include a bending portion 430. The bending portion 430 may be positioned at a central portion of each of the side portions 431, 432, 433 and 434. Each of the side portions 431, 432, 433 and 434 may be divided into two portions with respect to the bending portion 430. For example, the side portions 431, 432, 433 and 434 may be divided into a first portion 43*a* positioned closer to a support portion 450 with respect to the bending portion 430 and a second portion 43*b* positioned farther from the support portion 450 with respect to the bending portion 430. The first portion 43*a* may protrude further outwards than the second portion 43*b* due to the bending portion 430 (e.g., the first portion 43*a* may protrude further in the circumferential direction than the second portion 43*b*).

The support portion 450 may be positioned on the outer circumferential surface of the shank 400. The support portion 450 may have a shape surrounding the base portion 410 of the shank 400. For example, the support portion 450 may have a ring shape surrounding the outer circumferential surface of the base portion 410. The support portion 450 may be integrally formed with the shank 400. In some embodiments, the support portion 450 may be omitted.

Figure 6:
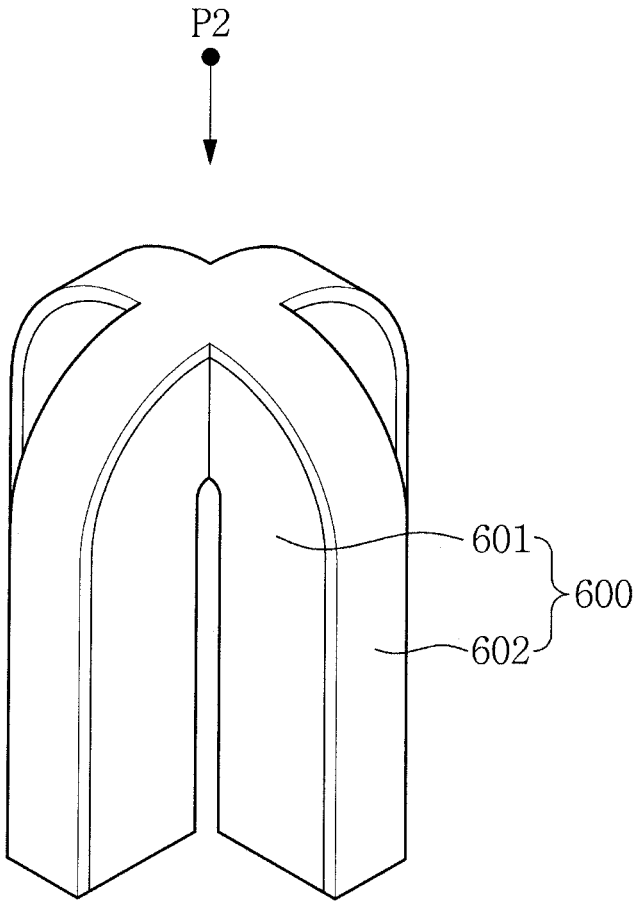
FIG. 6 is an enlarged view illustrating a lapping portion of FIG. 3.
Figure 7:
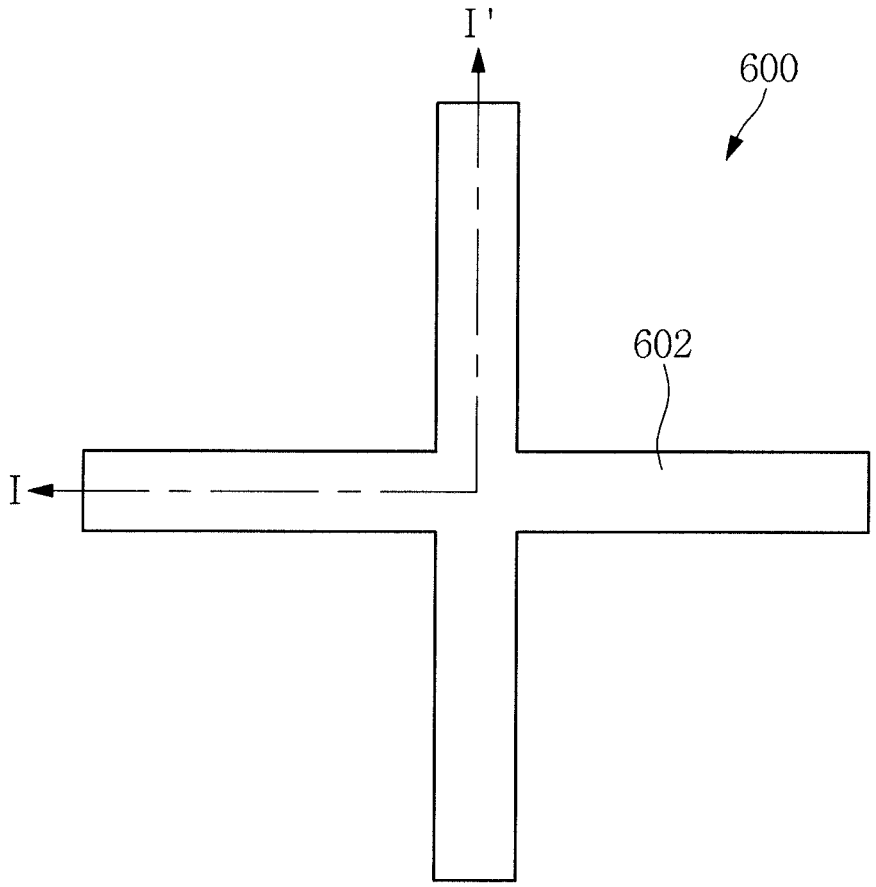
FIG. 7 is a view illustrating the lapping portion of FIG. 6 viewed from a reference point P2 of FIG. 6.

FIG. 6 is an enlarged view illustrating the lapping portion 600 of FIG. 3, and FIG. 7 is a view illustrating the lapping portion 600 of FIG. 6 viewed from a reference point P2 of FIG. 6. FIG. 7 illustrates a shape of the lapping portion 600 of FIG. 6 that is spread apart relative to the view in FIG. 6.

The lapping portion 600 may be inserted into the groove 55 of the shank 400. The lapping portion 600 may have substantially the same shape as the shape of the groove 55. For example, the lapping portion 600 may have a cross shape, as illustrated in FIG. 7.

The lapping portion 600 may include a first portion positioned at a tip portion of the shank 400 when the lapping portion 600 is coupled to the shank 400, and a second portion that is positioned at an outer circumferential surface of the shank 400 when the lapping portion 600 is coupled to the shank 400. For example, when the lapping portion 600 is coupled to the shank 400, the first portion of the lapping portion 600 may be positioned at the first part of the groove 55, and the second portion of the lapping portion 600 may be positioned at the second part of the groove 55.

When the lapping portion 600 is inserted into the groove 55 of the shank 400, the first portion of the lapping portion 600 positioned at the first part of the groove 55 may have a cross shape, and the second portion of the lapping portion 600 positioned at the second part of the groove 55 may have a linear shape.

In some embodiments, the lapping portion 600 may be fixed to the shank 400 by an adhesive. For example, an adhesive may be positioned between the lapping portion 600 and the groove 55 of the shank 400.

Figure 8:
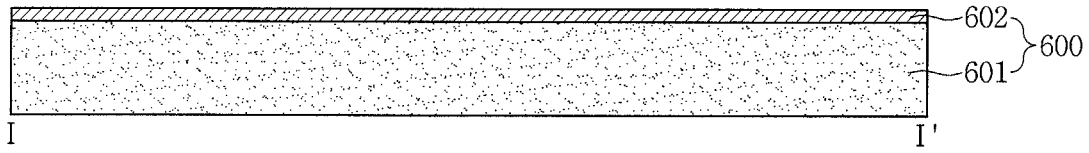
FIG. 8 is a cross-sectional view taken along line I-I' of FIG. 7.

FIG. 8 is a cross-sectional view taken along line I-I' of FIG. 7.

As illustrated in FIG. 8, the lapping portion 600 may include an elastic member 601 and an abrasive layer 602 that are vertically stacked.

As illustrated in FIGS. 2 and 8, the elastic member 601 may be positioned between the abrasive layer 602 and the shank 400, and may be positioned in the groove 55 of the shank 400. In such embodiments, a portion of the elastic member 601 and the abrasive layer 602 may protrude outside of the groove 55. Further, as described above, an adhesive may be positioned between the elastic member 601 and the groove 55 of the shank 400.

In some embodiments, the elastic member 601 may have a cross shape.

In some embodiments, the elastic member 601 may be a sponge. In addition, in some embodiments, the elastic member 601 may be a material having elasticity, such as a rubber material.

The abrasive layer 602 of the lapping portion 600 may include at least one of diamond, a ceramic ball, an alumina ball and a zirconia ball. In some embodiments, the abrasive layer 602 may include sandpaper.

In some embodiments, the abrasive layer 602 may have a cross shape.

Figure 9:
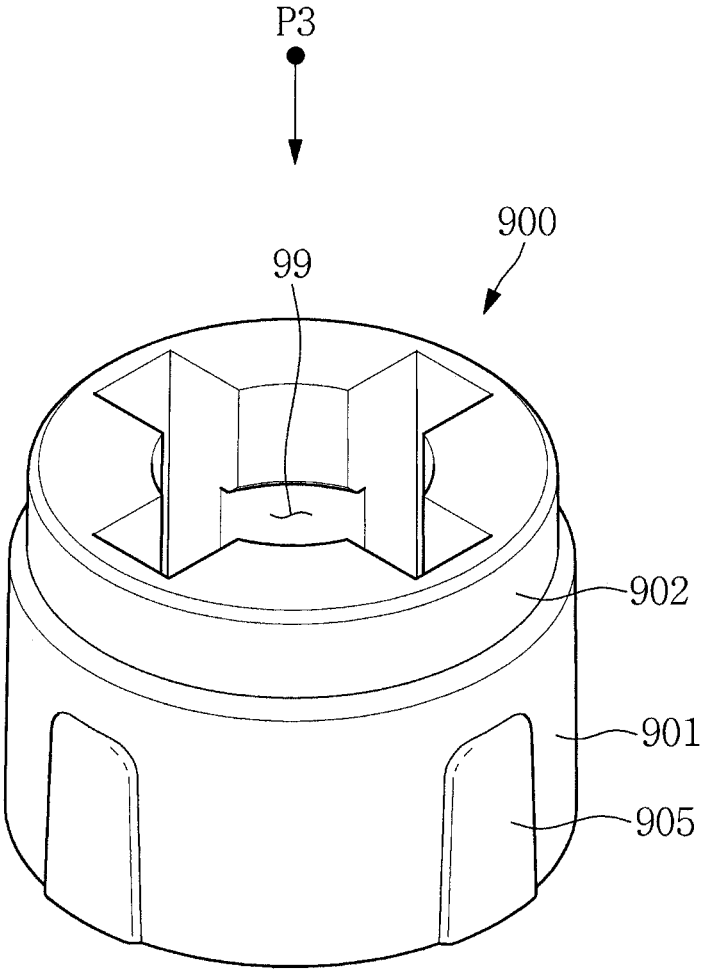
FIG. 9 is an enlarged view illustrating a fastening portion of FIG. 3.
Figure 10:
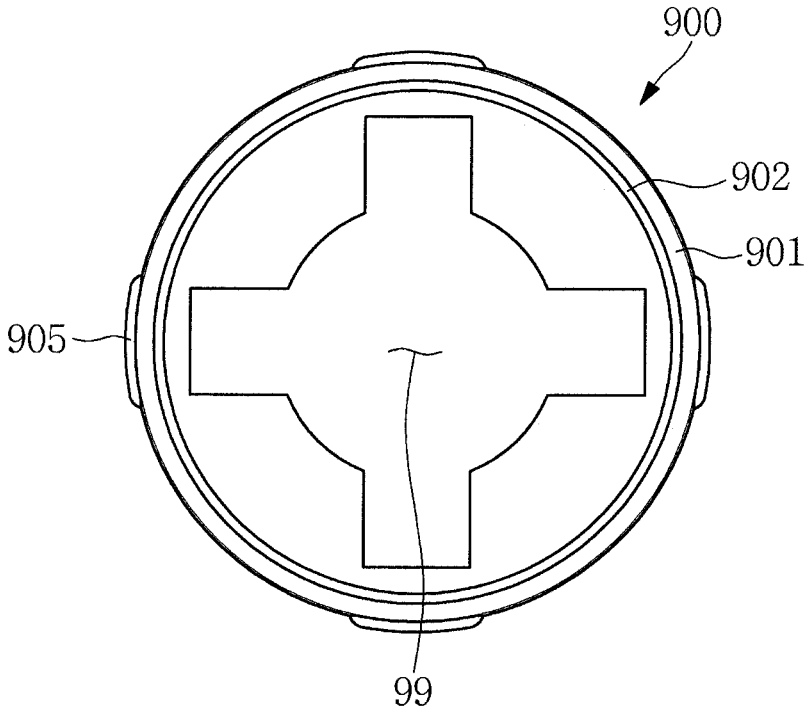
FIG. 10 is a view illustrating the fastening portion of FIG. 9 viewed from a reference point P3 of FIG. 9.

FIG. 9 is an enlarged view illustrating the fastening portion 900 of FIG. 3, and FIG. 10 is a view illustrating the fastening portion 900 of FIG. 9 viewed from a reference point P3 of FIG. 9.

The fastening portion 900 may surround an outer circumferential surface of the shank 400 and the lapping portion 600 on the outer circumferential surface of the shank 400 (see FIG. 2).

The fastening portion 900 has a hole or opening 99 defined therethrough. The lapping portion 600 and the shank 400 may be exposed to the outside of the fastening portion 900 through the hole 99 (e.g., the lapping portion 600 and the shank 400 may be inserted into the hole 99 of the fastening portion 900, such that the lapping portion 600 and the shank 400 extend through the hole 99 and outside of the fastening portion 900). The hole 99 may have substantially the same shape as the shape of the groove 55 of the shank 400. For example, the hole 99 may have a cross shape. For example, the hole 99 may have a shape in which a cross shape and a fan shape are combined.

The fastening portion 900 includes a first fastening portion 901 and a second fastening portion 902. The first fastening portion 901 surrounds a portion of the shank 400 positioned on one side of the bending portion 430 of the shank 400 (e.g., surrounding the first portion 43*a* of each of the side portions 431-434 of the shank 400). The second fastening portion 902 surrounds a second portion of the shank 400 positioned on the opposite side of the bending portion 430 of the shank 400 (e.g., surrounding the second portion 43*b* of each of the side portions 431-434 of the shank 400). The first fastening portion 901 and the second fastening portion 902 may each have a ring shape. The first fastening portion 901 has a larger diameter than a diameter of the second fastening portion 902. The first fastening portion 901 may be placed on the support portion 450.

The fastening portion 900 may further include at least one protrusion 905 positioned on an outer circumferential surface of the fastening portion 900. For example, the protrusion 905 may be positioned on an outer circumferential surface of the first fastening portion 901. When the fastening portion 900 is being fitted to the shank 400 or is being detached from the shank 400 by an operator, the protrusion 905 serves to substantially prevent the fastening portion 900 from slipping from the hand of the operator.

Figure 11:
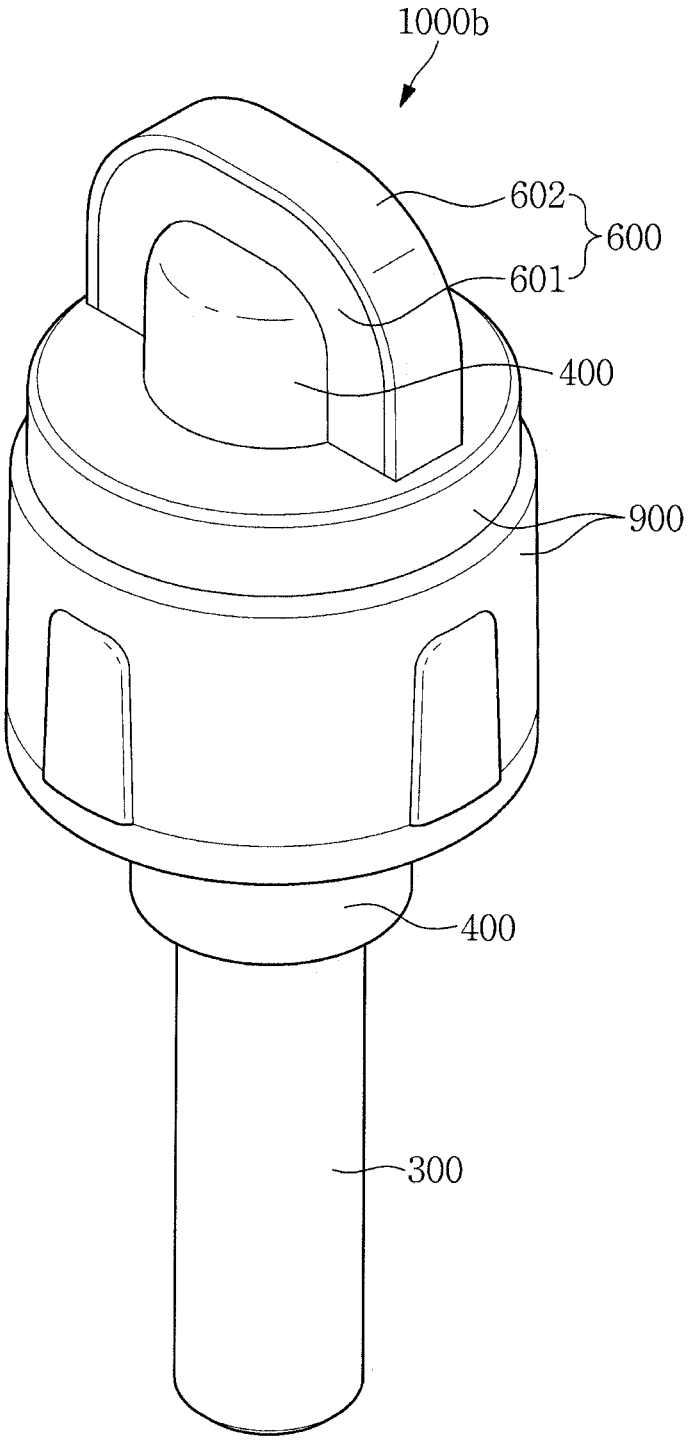
FIG. 11 is a view illustrating a wheel unit of FIG. 1 according to some embodiments.
Figure 12:
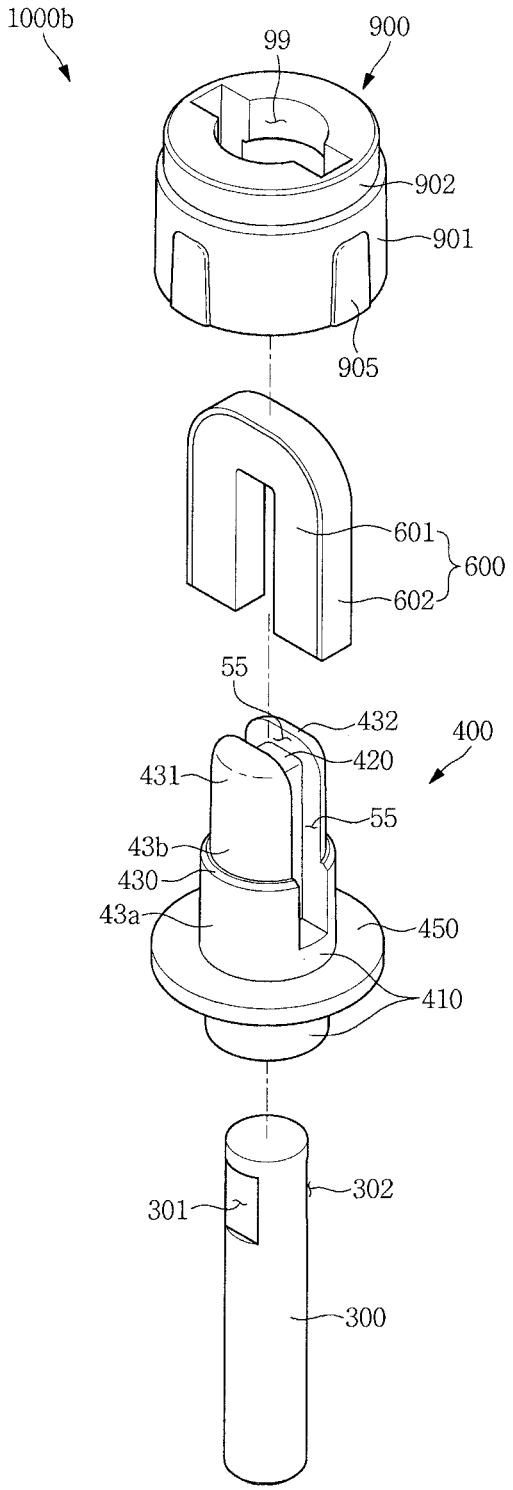
FIG. 12 is an exploded perspective view illustrating the wheel unit of FIG. 11.

FIG. 11 is a view illustrating a wheel unit 1000*b* of FIG. 1 according to some embodiments, and FIG. 12 is an exploded perspective view illustrating the wheel unit 1000*b* of FIG. 11.

As illustrated in FIGS. 11 and 12, each of the first part of the groove 55 at the tip portion of the shank 400, and the second parts of the groove 55 at the outer circumferential surface of the shank 400 may have a linear shape.

In addition, as illustrated in FIGS. 11 and 12, the shank 400 may include two side portions 431 and 432. Each of the side portions 431 and 432 of the shank 400 may extend (e.g., protrude) from an edge of a base portion 410. Each of the side portions 431 and 432 may extend (e.g., protrude) in a direction parallel to the axial direction of the driving shaft 300.

As illustrated in FIG. 12, each of the side portions 431 and 432 may be positioned around the central portion 420. In other words, the side portions 431 and 432 oppose each other (e.g., face each other) with the central portion 420 therebetween. For example, as illustrated in FIG. 12, the side portions 431 and 432 may be positioned relative to (e.g., corresponding to) two surfaces of the central portion 420, respectively. Each of the side portions 431 and 432 may have two surfaces that are substantially parallel to the axial direction of the driving shaft 300 and that have a relatively large surface area, such that the side portions 431 and 432 together form four such surfaces (i.e., two pairs of surfaces of the side portions 431, 432 that face each other).

As illustrated in FIGS. 11 and 12, a lapping portion 600 may be inserted into the groove 55 of the shank 400. The lapping portion 600 includes the elastic member 601 and the abrasive layer 602 as described above.

The lapping portion 600 may have substantially the same shape as the shape of the groove 55. For example, the lapping portion 600 may have a linear shape, as illustrated in FIG. 12. When the lapping portion 600 is inserted into the groove 55 of the shank 400, the first portion of the lapping portion 600 at the first part of the groove 55 (e.g., at the tip portion of the shank 400) may have a linear shape, and the second portion of the lapping portion 600 at the second part of the groove 55 (e.g., at the outer circumferential surface of the shank 400) may also have a linear shape.

The elastic member 601 and the abrasive layer 602 of the lapping portion 600 may each have a linear shape.

As illustrated in FIGS. 11 and 12, the fastening portion 900 has the hole or opening 99 defined therethrough. The lapping portion 600 and the shank 400 may be exposed to the outside of the fastening portion 900 through the hole 99 (e.g., the lapping portion 600 and the shank 400 may be inserted into the hole 99 of the fastening portion 900, such that the lapping portion 600 and the shank 400 extend through the hole 99 and outside of the fastening portion 900). The hole 99 may have a linear shape. For example, the hole 99 may have a shape in which a linear shape and a fan shape are combined.

Figure 13:
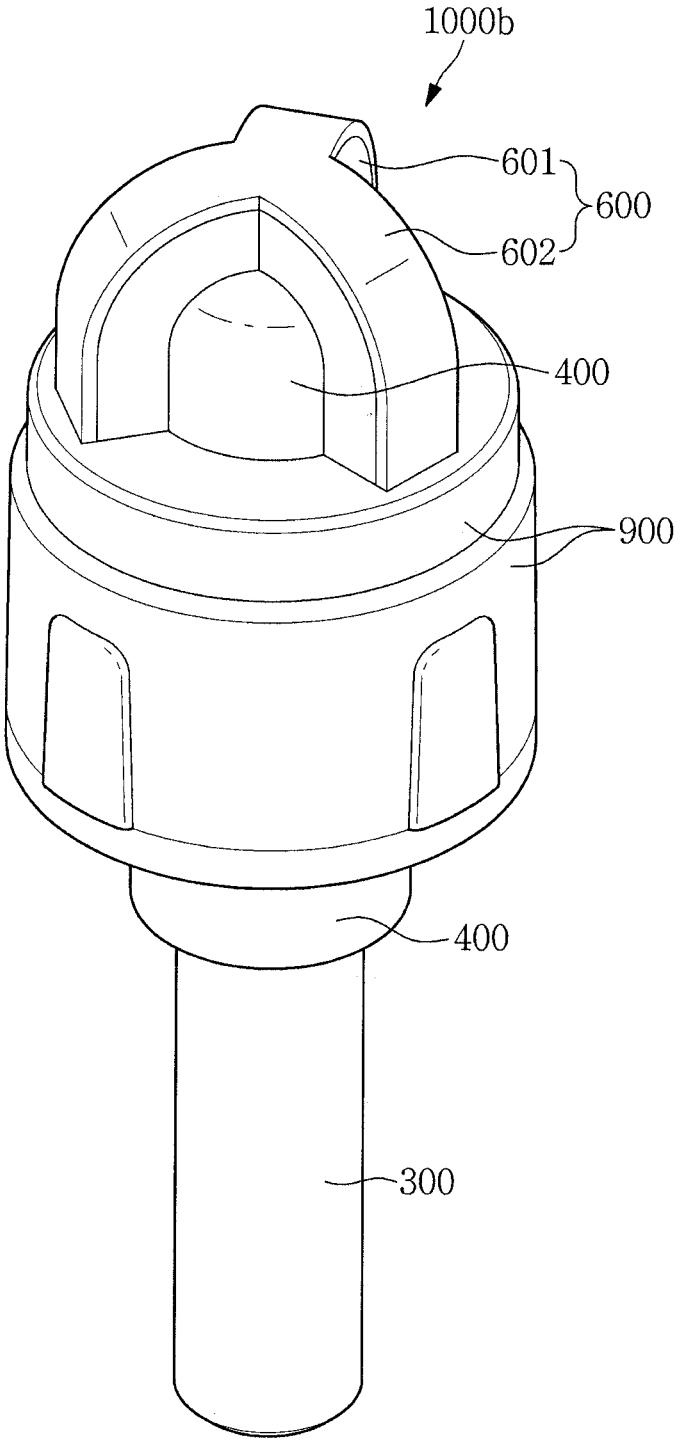
FIG. 13 is a view illustrating a wheel unit of FIG. 1 according to some embodiments.
Figure 14:
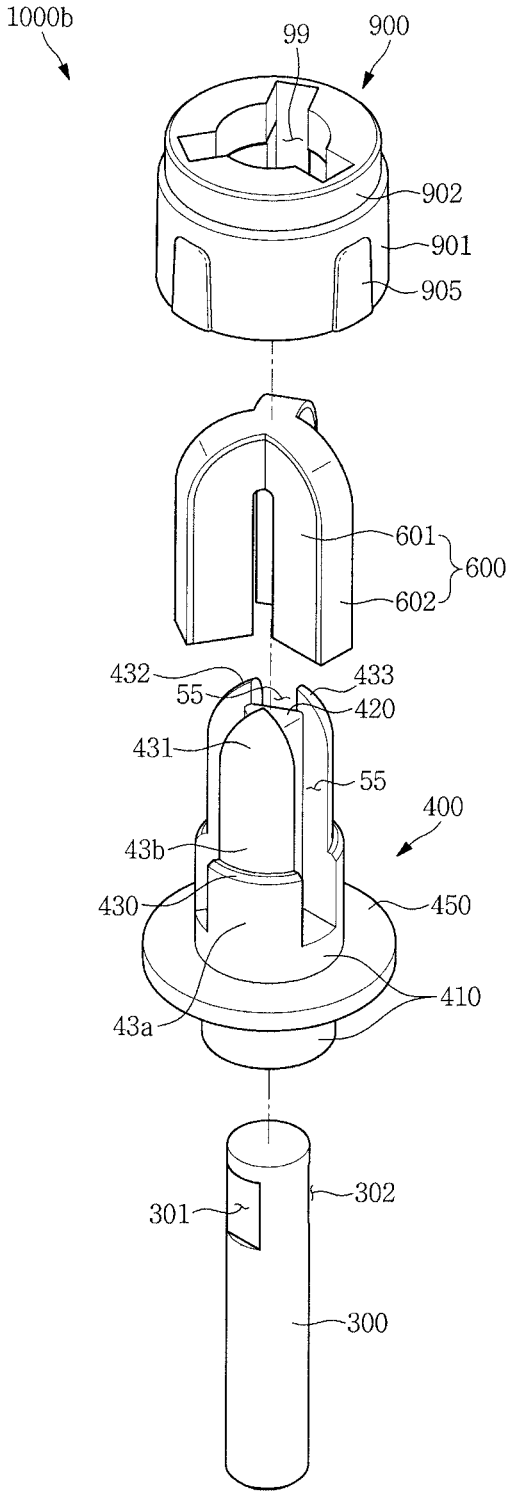
FIG. 14 is an exploded perspective view illustrating the wheel unit of FIG. 13.

FIG. 13 is a view illustrating a wheel unit 1000*b* of FIG. 1 according to some embodiments, and FIG. 14 is an exploded perspective view illustrating the wheel unit 1000*b* of FIG. 13.

As illustrated in FIGS. 13 and 14, the first part of the groove 55 at the tip portion of the shank 400 may have a Y-like shape, and the second part of the groove 55 in the outer circumferential surface of a shank 400 may have a linear shape.

In addition, as illustrated in FIGS. 13 and 14, the shank 400 may include three side portions 431, 432 and 433. Each of the side portions 431, 432 and 433 of the shank 400 may extend (e.g., protrude) from an edge of a base portion 410. Each of the side portions 431, 432 and 433 may extend (e.g., protrude) in a direction parallel to the axial direction of the driving shaft 300.

As illustrated in FIG. 14, each of the side portions 431, 432 and 433 may be positioned around the central portion 420. For example, as illustrated in FIG. 14, the side portions 431, 432 and 433 may be positioned adjacent to (e.g., corresponding to) three relatively long edges of the central portion 420, respectively, that are substantially parallel to the axial direction of the driving shaft 300.

As illustrated in FIGS. 13 and 14, the lapping portion 600 may be inserted into the groove 55 of the shank 400. The lapping portion 600 includes the elastic member 601 and the abrasive layer 602 as described above.

The lapping portion 600 may have substantially the same shape as the shape of the groove 55. For example, the lapping portion 600 may have a Y-like shape, as illustrated in FIG. 14. When the lapping portion 600 is inserted into the groove 55 of the shank 400, the first portion of the lapping portion 600 at the first part of the groove 55 (e.g., at the tip portion of the shank 400) may have a Y-like shape and the second portion of the lapping portion 600 at the second part of the groove 55 (e.g., at the outer circumferential surface of the shank 400) may have a linear shape.

In some embodiments, the elastic member 601 and the abrasive layer 602 of the lapping portion 600 may each have a Y-like shape.

As illustrated in FIGS. 13 and 14, the fastening portion 900 has the hole 99 defined therethrough. The lapping portion 600 and the shank 400 may be exposed to the outside of the fastening portion 900 through the hole 99 (e.g., the lapping portion 600 and the shank 400 may be inserted into the hole 99 of the fastening portion 900, such that the lapping portion 600 and the shank 400 extend through the hole 99 and outside of the fastening portion 900). The hole 99 may have a Y-like shape.

In some embodiments, the shape of the groove 55 positioned at the tip portion of the shank 400 is not limited to the above-described shapes. That is, the groove 55 at the tip portion of the shank 400 may have various shapes other than the above-mentioned cross, linear and Y-like shapes. For example, the groove 55 at the tip portion of the shank 400 may have a star (*)-like shape or a #-like shape.

Similarly, the shape of the lapping portion 600 is not limited to the above-described shapes. That is, the lapping portion 600 may have various shapes other than the above-mentioned cross, linear and Y-like shapes. For example, the lapping portion 600 may have a star (*)-like shape or a #-like shape.

Similarly, the shape of the hole 99 of the fastening portion 900 is not limited to the above-described shapes. That is, the hole 99 may have various shapes other than the above-mentioned cross, linear and Y-like shapes. For example, the hole 99 may have a star (*)-like shape or a #-like shape.

Figures 15, 16:
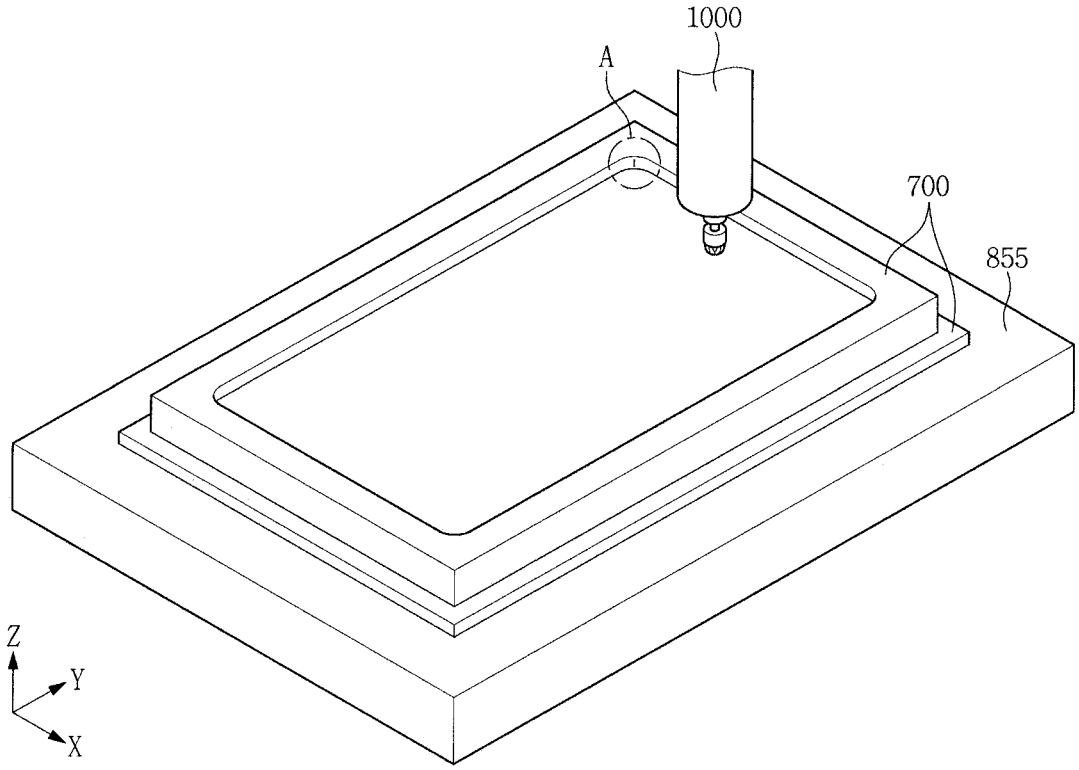
FIG. 15 is a view illustrating a method of lapping an object using the lapping device according to some embodiments.
FIG. 16 is an explanatory view illustrating the effects of the lapping device according to some embodiments.

FIG. 15 is a view illustrating a method of lapping an object using the lapping device 1000 according to some embodiments.

As illustrated in FIG. 15, an object 700 is placed on a stage 855. The object 700 may be a mold. The mold may be, for example, a mold for manufacturing a window of a mobile display device. The mold may include a graphite material.

The stage 855 is movable in an X-axis direction and a Y-axis direction.

The lapping device 1000 according to some embodiments is placed on the stage 855. The lapping device 1000 may be fastened to a separate moving device. The moving device is movable in a Z-axis direction to move the lapping device 1000 in the Z-axis direction.

The stage 855 and the lapping device 1000 may be controlled by a separate control device. The control device may control the movement of the stage 855 in the X-axis direction and the Y-axis direction, and the movement of the moving device in the Z-axis direction. In addition, the control device may control an angle of the lapping device 1000 and a rotational speed of the shank 400 provided in the lapping device 1000.

The angle of the lapping device 1000 that may be controlled by the control device may be an inclined angle of the driving shaft 300 with respect to a surface of the stage 855 in contact with the object 700. In other words, the angle of the lapping device 1000 may be an angle formed between the driving shaft 300 provided in the lapping device 1000 and the surface of the stage 855. For example, the surface may be an interfacial surface between the stage 855 and the object 700.

The rotational speed of the shank 400 may be a rotational speed of the driving shaft 300.

As illustrated in FIG. 15, the object 700 may have a surface having a shape of a curved surface A at its edge.

The lapping portion 600 provided in the lapping device 1000 according to some embodiments contacts the surface of the object 700. When the lapping portion 600 rotates, the surface of the object 700 is lapped by the abrasive layer 602 of the lapping portion 600.

The lapping device 1000 according to some embodiments includes the elastic member 601 having elasticity such that even through the surface of the object 700 has a complicated shape that may be difficult to lap (e.g., a curved surface A), the lapping portion 600 may be transformed (e.g., elastically deformed) in accordance with the shape of the surface thereof to lap the surface. Accordingly, the lapping portion 600 may closely contact the surface of the object 700. As a result, the lapping device 1000 according to some embodiments may more precisely lap the surface of the object 700 having a complicated shape (e.g., as compared to conventional lapping devices).

In some embodiments, the stage 855 may move in the X-axis direction, the Y-axis direction and the Z-axis direction. In such embodiments, the lapping device 1000 may remain stationary and may not move. However, the angle of the lapping device 1000 may change.

FIG. 16 is an explanatory view illustrating the effects of the lapping device 1000 according to some embodiments.

According to a table of FIG. 16, in the case where the object 700 (i.e., a mold for manufacturing a window of a display device) of FIG. 15 was lapped by a conventional lapping device, a surface roughness of the mold 700 was measured to be in a range from about 1.0 μm to about 2 μm. On the other hand, in the case where the mold 700 of FIG. 15 was lapped by the lapping device 1000 according to some embodiments, the surface roughness of the mold 700 was measured to be in a range from about 0.6 μm to about 0.8 μm. Herein, the unit of the surface roughness is Ra (an arithmetic average surface roughness).

According to the table of FIG. 16, in the case where the mold 700 of FIG. 15 was lapped by the conventional lapping device, an amount of dimension change of the mold 700 was measured to be in a range from about 0 μm to about 10 μm. On the other hand, in the case where the mold 700 of FIG. 15 was lapped by the lapping device 1000 according to an exemplary embodiment, an amount of dimension change of the mold 700 was measured to be in a range from about 2 μm to about 5 μm.

According to the table of FIG. 16, a time for lapping the mold 700 of FIG. 15 by the conventional lapping device was measured to be about 80 minutes in total. For example, a time for lapping each of a frontal surface and a rear surface of the mold 700 was measured to be about 40 minutes for each of the frontal and rear surfaces. On the other hand, a time for lapping the mold 700 of FIG. 15 by the lapping device 1000 according to some embodiments was measured to be about 40 minutes in total. For example, a time for lapping each of a frontal surface and a rear surface of the mold 700 was measured to be about 20 minutes for each of the frontal and rear surfaces.

As such, the lapping device 1000 according to some embodiments may provide improved surface roughness, a smaller amount of mold dimension change, and faster working times as compared with conventional lapping devices.

As set forth hereinabove, the lapping device according to one or more example embodiments may provide the following effects.

A lapping portion of the lapping device has elasticity such that even through a surface of an object to be lapped has a complicated shape (e.g., a curved line), the lapping portion may be transformed (e.g., elastically deformed) in accordance with the shape of the surface thereof to lap the surface. Accordingly, the lapping portion may closely contact the surface of the object. As a result, the lapping device according to one or more example embodiments may more precisely lap the surface of the object having a complicated shape as compared with conventional lapping devices.

In addition, the lapping device according to one or more example embodiments may provide improved surface roughness, a smaller amount of mold dimension change, and faster working times as compared with conventional lapping devices.

Although example embodiments of the present invention have been described, it is understood that the present invention is not limited to these example embodiments, but various changes and modifications can be made by one of ordinary skill in the art within the spirit and scope of the present invention as hereinafter claimed.

Therefore, the disclosed subject matter is not be limited to any single embodiment described herein, and the above-described embodiments are to be considered illustrative and not restrictive. Accordingly, the scope of the present inventive concept shall be determined only according to the attached claims, and equivalents thereof.

What is claimed is:

1. A lapping device comprising:

a driving unit;

a shank connected to the driving unit through a driving shaft; and a lapping portion coupled to the shank, the lapping portion comprising:

an abrasive layer; and an elastic member between the abrasive layer and the shank, wherein the elastic member covers an outer circumferential surface of the shank, the outer circumferential surface surrounding the driving shaft.

2. The lapping device as claimed in claim 1, wherein the abrasive layer comprises sandpaper.

3. The lapping device as claimed in claim 1, wherein the elastic member comprises a sponge.

4. The lapping device as claimed in claim 1, further comprising an adhesive between the elastic member and the shank.

5. The lapping device as claimed in claim 1, wherein a first portion of the lapping portion is positioned at a tip portion of the shank and a second portion of the lapping portion is positioned at the outer circumferential surface of the shank.

6. The lapping device as claimed in claim 5, wherein the first portion of the lapping portion has a shape selected from a linear shape, a cross shape, a Y-like shape, a star-like shape and a #-like shape.

7. The lapping device as claimed in claim 5, wherein the second portion of the lapping portion has a linear shape.

8. The lapping device as claimed in claim 1, wherein the shank has a groove into which at least a portion of the elastic member is inserted.

9. The lapping device as claimed in claim 8, wherein a portion of the elastic member extends outside of the shank through the groove.

10. The lapping device as claimed in claim 9, wherein a first part of the groove is positioned at a tip portion of the shank and a second part of the groove is positioned at an outer circumferential surface of the shank.

11. The lapping device as claimed in claim 10, wherein the first part of the groove has a shape selected from a linear shape, a cross shape, a Y-like shape, a star-like shape and a #-like shape.

12. The lapping device as claimed in claim 10, wherein the second part of the groove has a linear shape.

13. The lapping device as claimed in claim 1, further comprising a fastening portion surrounding an outer circumferential surface of the shank and the lapping portion on the outer circumferential surface of the shank.

14. The lapping device as claimed in claim 13, wherein the fastening portion has a hole through which a portion of the lapping portion and a portion of the shank are exposed.

15. The lapping device as claimed in claim 1, wherein the entire lapping portion is removably coupled to the shank.

16. The lapping device as claimed in claim 8, wherein the elastic member has a plurality of spaced apart extensions configured to be inserted into the groove.

17. The lapping device as claimed in claim 1, wherein the lapping portion has an elongate shape with a first end and an opposite second end.

18. The lapping device as claimed in claim 17, wherein the first end of the lapping portion comprises a narrowing tip and the second end of the lapping portion comprises an opening for connecting the elastic member to the shank via a groove in the shank.

19. The lapping device as claimed in claim 1, wherein the elastic member includes a bending portion.

20. A lapping device comprising:

a driving unit;

a shank connected to the driving unit through a driving shaft; and a lapping portion coupled to the shank, the lapping portion comprising:

an abrasive layer; and an elastic member between the abrasive layer and the shank, wherein the elastic member includes a bending portion in contact to the shank.

21. The lapping device as claimed in claim 1, wherein the elastic member covers an outer circumferential surface of the shank, the outer circumferential surface surrounding the driving shaft.

* * * * *